US006267529B1

(12) United States Patent
Mudryk et al.

(10) Patent No.: US 6,267,529 B1
(45) Date of Patent: Jul. 31, 2001

(54) FLEXIBLE TRAFFIC POST

(75) Inventors: Boydan Joseph Mudryk, Seaham; Garry David Campbell, Valentine, both of (AU)

(73) Assignee: Rondo Building Services Pty. Ltd., St. Marys (AU)

( * ) Notice: Subject to any disclaimer, the term of this patent is extended or adjusted under 35 U.S.C. 154(b) by 0 days.

(21) Appl. No.: 09/303,964

(22) Filed: May 3, 1999

Related U.S. Application Data

(63) Continuation-in-part of application No. 08/943,245, filed on Oct. 3, 1997, now abandoned.

(30) Foreign Application Priority Data

Oct. 4, 1996 (AU) ..... PO2822

(51) Int. Cl.[7] ..... E01F 9/00; F16M 13/00
(52) U.S. Cl. ..... 404/10; 116/63 R; 248/160
(58) Field of Search ..... 404/10, 11; 116/63 R; 40/608; 52/113; 248/160

(56) References Cited

U.S. PATENT DOCUMENTS

| | | | |
|---|---|---|---|
| H1588 | 9/1996 | Arney . | |
| 2,186,403 | 1/1940 | Bullis et al. . | |
| 2,254,566 | 9/1941 | Cornell, Jr. . | |
| 2,283,607 | 5/1942 | Ludwig . | |
| 2,949,324 | 8/1960 | Birge et al. . | |
| 3,847,497 | 11/1974 | Guillory, Sr. . | |
| 3,875,720 | 4/1975 | Russell . | |
| 4,032,248 * | 6/1977 | Parduhn et al. | 404/10 |
| 4,126,403 * | 11/1978 | Sweeney et al. | 403/2 |
| 4,297,050 * | 10/1981 | Gmelch | 404/10 |
| 4,298,292 | 11/1981 | Sweeney . | |
| 4,435,107 * | 3/1984 | Sweeney | 404/10 |
| 4,792,088 | 12/1988 | Bonnell . | |
| 5,040,478 | 8/1991 | Hughes . | |
| 5,207,175 | 5/1993 | Andonian . | |
| 5,214,886 * | 6/1993 | Hugron | 52/98 |
| 5,439,311 | 8/1995 | Hughes, Jr. . | |
| 5,626,418 | 5/1997 | Angelis, Sr. et al. . | |
| 5,788,405 | 8/1998 | Beard . | |
| 5,803,647 | 9/1998 | Hughes . | |

OTHER PUBLICATIONS

Brochure By Delnorth PTY, LTD,. (Australia) Feb. 1998.

* cited by examiner

*Primary Examiner*—Thomas B. Will
*Assistant Examiner*—Gary S. Hartmann
(74) *Attorney, Agent, or Firm*—Frommer Lawrence & Haug LLP; William S. Frommer

(57) ABSTRACT

A traffic post (41,51) comprises a longitudinally extending upper post section (2), a longitudinally extending lower post section (4) adapted to be driven into a support base, and a longitudinally extending elastically flexible unitary coupling member (43,53) fastened to the upper and lower post sections (2,4). The coupling member is fastened to the upper and lower post sections with a front face thereof abutting a rear face of each of the upper and lower post sections. The coupling member has a width greater than a depth thereof so as to enable deflection in a fore and aft direction perpendicular to the width.

16 Claims, 9 Drawing Sheets

FLEXIBLE TRAFFIC POST

CROSS REFERENCE TO RELATED APPLICATIONS

This application is a continuation-in-part of Ser. No. 08/943,245 filed Oct. 3, 1997, now abandoned.

TECHNICAL FIELD

The present invention relates to upright traffic posts used adjacent to roadways and in particular to a flexible traffic post.

BACKGROUND OF THE INVENTION

Traffic posts are located alongside roadways to help guide traffic along the road, particularly at night when reflectors mounted on the posts indicate the path the road takes into the distance. These posts have traditionally been constructed of a square timber cross section and have been installed by driving them into the ground, or by securing them in bore holes dug into the ground with cement if required The posts are arranged at regular intervals along the roadway, particularly in country areas. Galvanised steel extrusions are also commonly used as traffic guide posts and are rigidly secured to the ground in a similar manner.

Traffic posts are also used to carry traffic signs (e.g. give way, speed limit and street signs) and are typically located either beside the roadway or on a median strip or roundabout. These traffic posts are commonly manufactured from extruded tubular or channel galvanised steel sections and are also rigidly secured either as above or by fastening the posts to a concrete surface by means of a flat base When a vehicle strays from the roadway and impacts a traffic post, a large impact force and moment about the base of the post result. The post is then typically damaged irreparably and/or uprooted from its rigid mounting, thereby contributing to excessive repair and replacement expenses. The impact force may also cause considerable and costly damage to the impacting vehicle as well as injury to the occupants travelling therein.

Whilst various forms of flexible posts have been proposed, the known posts typically suffer from various setbacks including difficulty in installing, poor performance in returning to the upright position after impact and excessive costs associated with complicated hinge structures.

OBJECT OF THE INVENTION

It is the object of the present invention to overcome or substantially ameliorate at least one of the above disadvantages.

SUMMARY OF THE INVENTION

There is disclosed herein a traffic post comprising:

a longitudinally extending upper post section, a longitudinally extending lower post section adapted to be driven into a support base, and a longitudinally extending elastically flexible unitary coupling member fastened to said upper and lower post sections, said coupling member being fastened to each of said upper and lower post sections with a front face thereof abutting a rear face of each of said upper and lower post sections, said coupling member having a width greater than a depth thereof so as to enable deflection in a fore and aft direction perpendicular to said width.

The coupling member typically has a longitudinally extending concave rear face.

In a preferred embodiment the coupling member is moulded of a plastics or elastomeric material, preferably polyurethane.

In the preferred embodiment, said upper and lower post sections are each in the form of a constant cross section channel, said upper and lower post rear faces each being disposed interiorly of the respective said channel such that said coupling member is disposed in said channels. The upper and lower post sections are preferably formed as substantially identical constant cross section "C" channels each having a web defining the post section rear face and opposing flanges projecting rearwardly from opposing lateral sides of said web.

Preferably, opposing side surfaces of said coupling member abut said opposing flanges. The front face of said coupling member is preferably moulded to conform to each of said upper and lower post section rear faces.

The coupling member is preferably fastened to at least one of said upper and lower post sections via fasteners passing through longitudinally extending slots, said slots being located and sized such that said upper and lower post sections are mutually longitudinally displaceable between an abutting relative position for driving of said post into said support base by a driving force applied to said upper post section and a longitudinally separated relative position for flexing of said coupling member. The slots will typically be provided in both of said upper and lower post sections.

In an alternate embodiment the coupling member may comprise a substantially planar flexible sheet member.

A lower end of said lower post section is typically provided with a triangular shaped cut out through said web so as to provide said lower post lower end with a fork-type configuration.

BRIEF DESCRIPTION OF THE DRAWINGS

A preferred form of the present invention will now be described by way of example with reference to the accompanying drawings wherein.

DETAILED DESCRIPTION OF THE PREFERRED EMBODIMENTS

Figure 1:
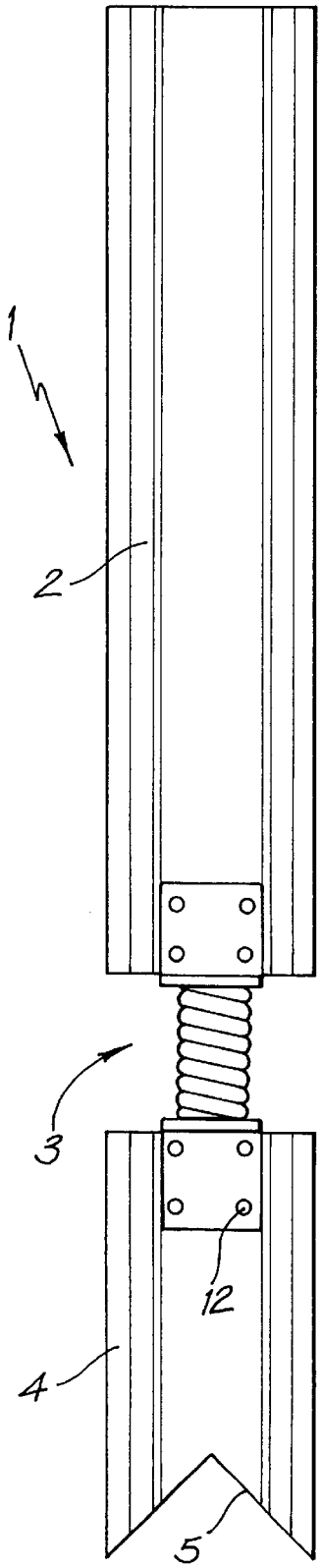
FIG. 1 is a front elevation view of a flexible traffic post according to a first embodiment of the current invention.
Figure 2:
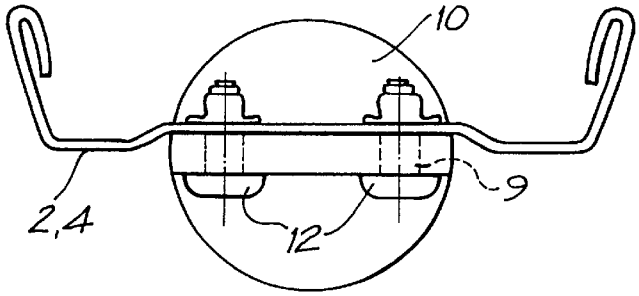
FIG. 2 is a plan view of the flexible traffic post of FIG. 1.
Figure 3:
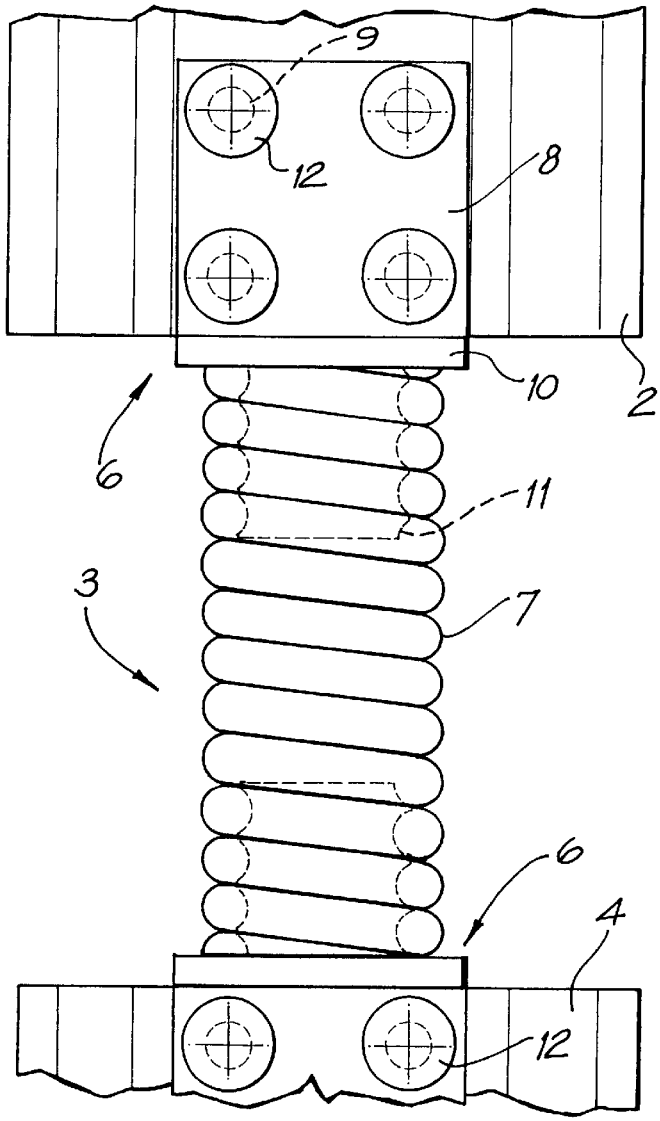
FIG. 3 is a fragmentary front elevation view of the flexible traffic post of FIG. 1.
Figure 4:
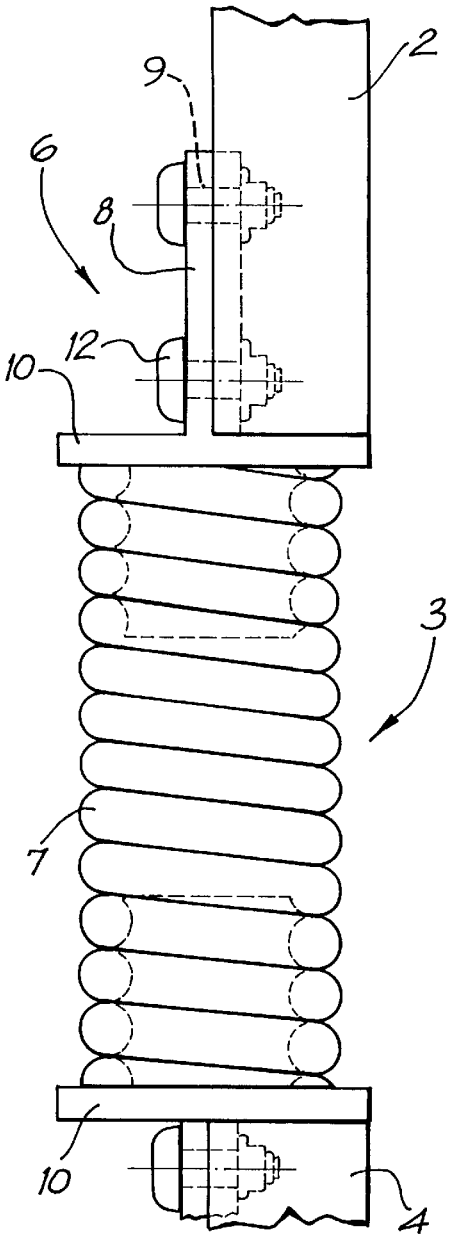
FIG. 4 is a fragmentary side view of the flexible traffic post of FIG. 1.
Figure 5:
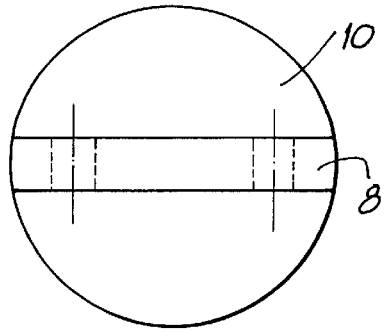
FIG. 5 is a plan view of a spring attachment member of the flexible traffic post of FIG. 1.
Figure 6:
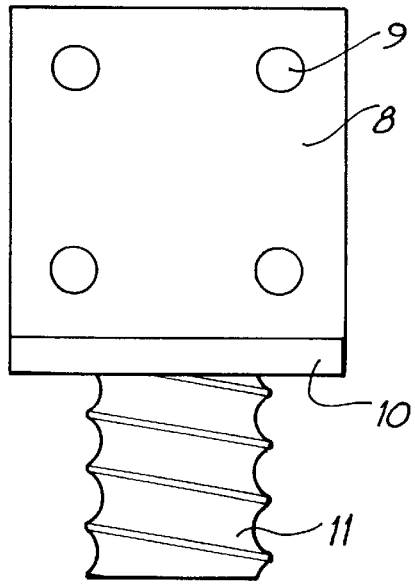
FIG. 6 is a front elevation view of the spring attachment member of FIG. 5.
Figure 7:
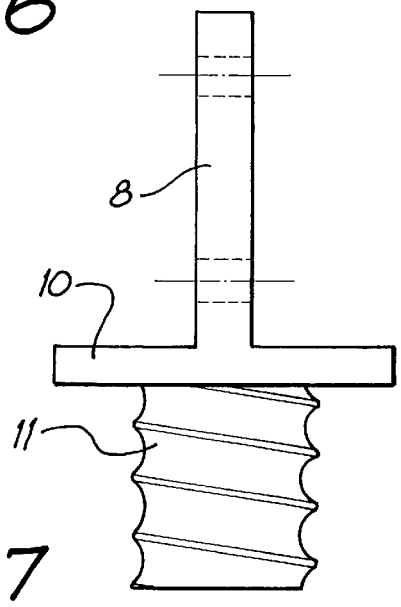
FIG. 7 is a side view of the spring attachment member of FIG. 5.

According to a first embodiment as depicted in FIGS. 1 through 7, a flexible traffic post 1 is provided with a longitudinally extending upper post section 2, a flexible coupling member 3 and a longitudinally extending lower post section 4. The upper and lower post sections 2m,4 are both here of the same constant cross section which is known from Australian Registered Design No. 124770. The upper and lower post sections 2,4 are extruded from galvanised steel and may be powder coated if required to improve their visibility and weather resistance. Road signs or reflectors may be fastened to the upper post 2 in the usual manner. A triangular cut-out region 5 is provided at the base of the lower post section 4 to facilitate the driving thereof into a support base such as the ground surface.

The flexible coupling member 3 of this embodiment comprises two spring attachment members 6 and a helical spring 7. Each spring attachment member 6 is provided with a planar attachment plate 8 through which is provided a plurality of attachment holes 9. A circular planar flange 10 is provided at an end of the attachment plate 8 and lies in a plane perpendicular thereto. Projecting perpendicularly from the face of the flange 10 opposing the attachment plate 8 is a threaded lug 11, onto which can be securely threaded the helical spring 7. The spring attachment members 6 of this embodiment are manufactured from mild steel, but any rigid material may be utilised. The helical spring 7 is wound from a spring steel which here is a high chromium-silicon content steel.

Figure 8:
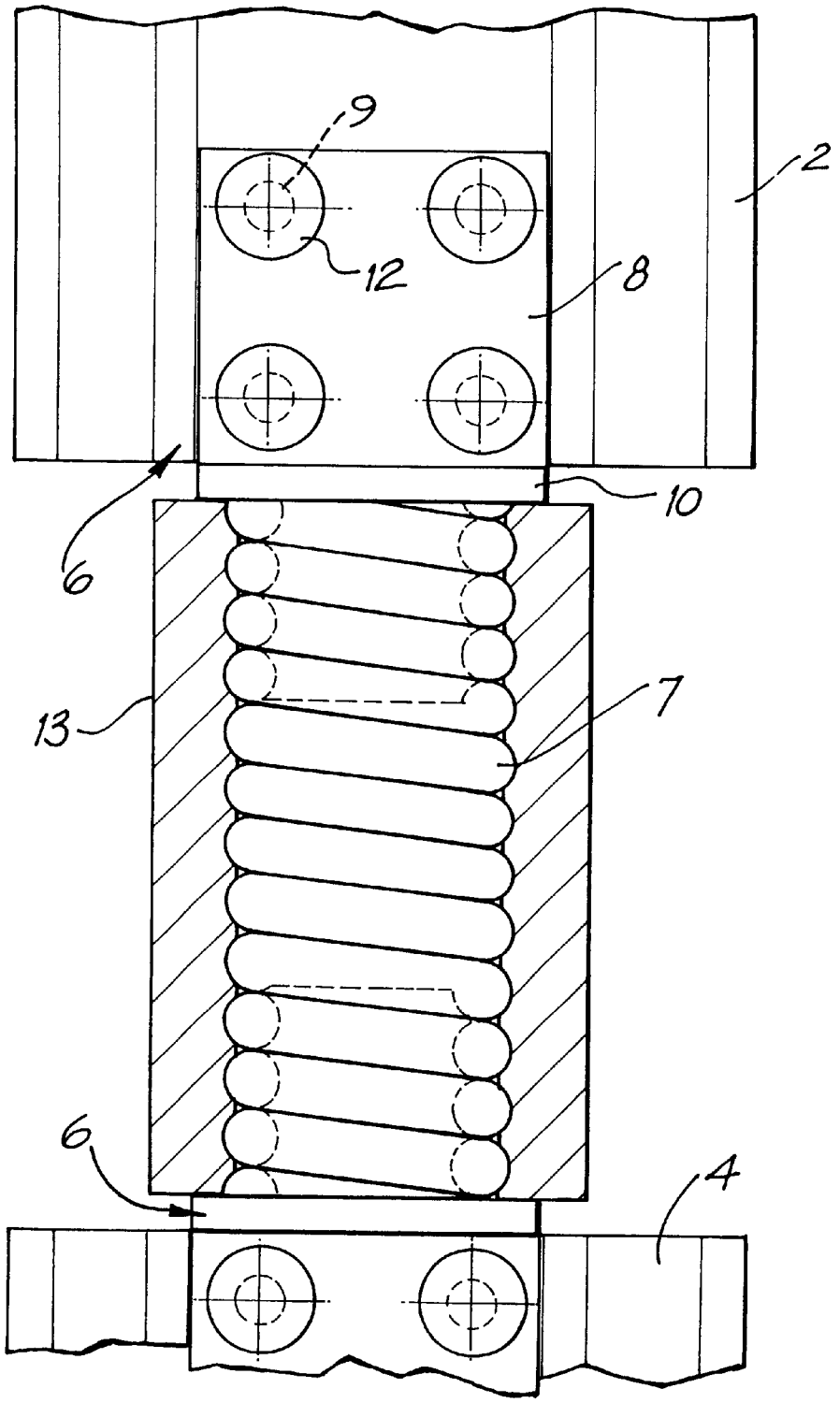
FIG. 8 is a fragmentary front elevation view similar to that of FIG. 3 with a moulded rubber sleeve (shown in cross-section) threaded onto the helical spring.

In a particularly preferred variation of the first embodiment depicted in FIG. 8, the helical spring 7 is encased in a moulded rubber sleeve 13 which threads onto the helical spring 7. This protects the helical spring 7 somewhat from the external environment and reduces the risk of children catching fingers between the coils of the helical spring 7.

During installation, the lower post section 4 is vertically driven into the ground at the required location. A first attachment member 6 is then fastened to a region of the lower post section 4 towards its top edge by means of fasteners 12 through the attachment plate 8 attachment holes 9 and corresponding holes provided in the lower post section 4. The helical spring 7 is threaded onto the attachment lug 11 such that the end of the spring 7 abuts the flange 10, thereby providing a rigid horizontal surface for the spring 7 to react against when deflected. If the moulded rubber sleeve 13 is to be fitted, it is threaded onto the helical spring 7. A second attachment member 6 is then threaded onto the upper end of the spring 7 in a similar manner, with the upper post section 2 then being fastened to the attachment plate 8 of the second attachment member 6, again with suitable fasteners 12.

Obviously the order of assembly is irrelevant. Rather than driving the lower post section 4 into the ground, it may be located in a pre-bored hole and, if required, cemented therein, The lower post section 4 should be located as deeply as possible such that the coupling member 3 is located adjacent the ground surface, thereby enabling flexion of the post 1 from near ground level.

In use, if the post 1 is impacted by a vehicle, the post will flex at the coupling member 3 by means of the spring 7. When the vehicle has passed and is clear of the post 1, the spring 7 will return the post 1 to the upright position (except on the off chance of the coupling member 3 being damaged by direct impact). The post 1 hence remains serviceable, and damage to the vehicle should be minimised. The spring coupling member 3 is effective for impact from any direction in a generally horizontal plane, and can also allow some twisting of the post 1 if a sign attached thereto is clipped on the side by a passing vehicle.

Figure 9:
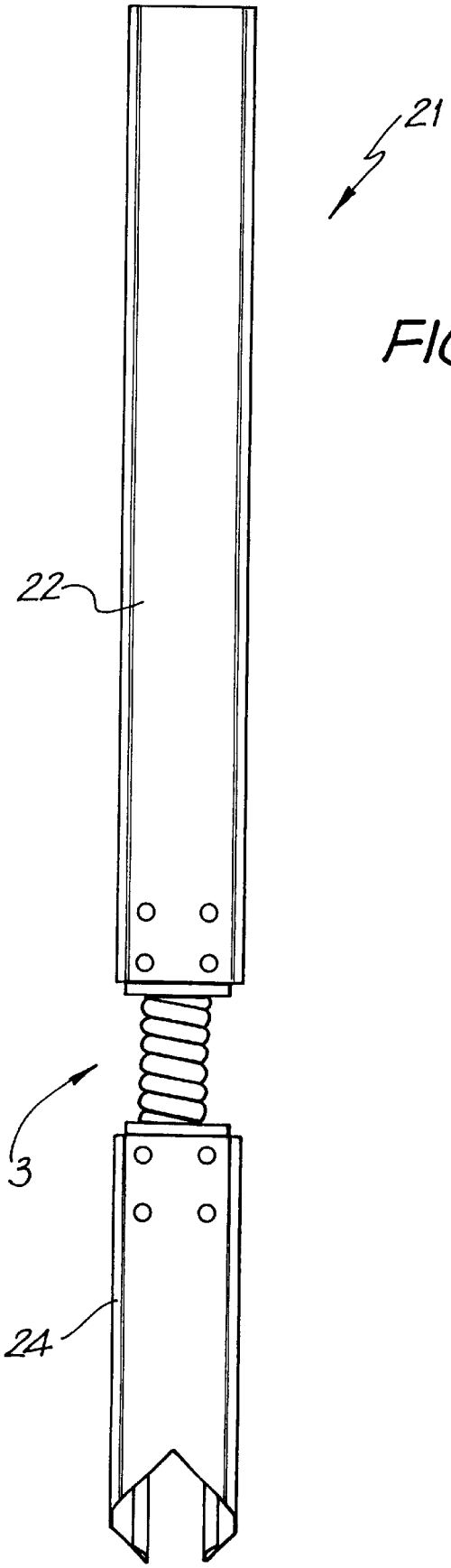
FIG. 9 is a front elevation view of a flexible traffic post according to a second embodiment of the current invention.
Figure 10:
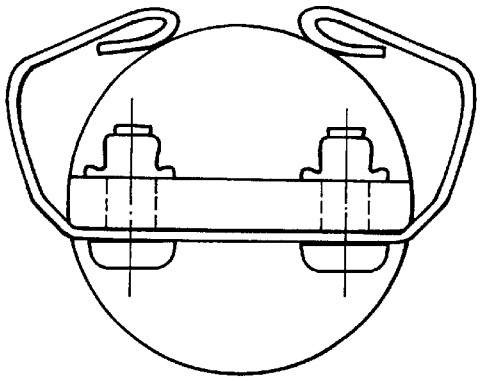
FIG. 10 is a plan view of the flexible traffic post of FIG. 9.

In a traffic post 21 according to a second embodiment, as depicted in FIGS. 9 and 10, the coupling member 3 arrangement is applied to upper and lower post sections 22, 24 extruded from a cross section as is known from Australian Registered Design No. 127843. The coupling member 3 can equally well be applied to any typical post sections and constructions, such as rectangular cross section timber posts or tubular steel posts with modifications to the spring attachment member 6 as required. Again, the moulded rubber sleeve 13 may be fitted to the helical spring 7 of this embodiment.

Figure 11:
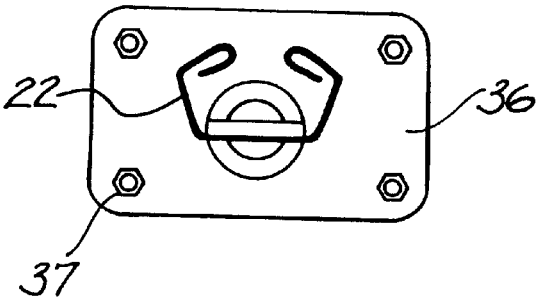
FIG. 11 is a plan view of a flexible traffic post according to a third embodiment of the current invention.
Figure 12:
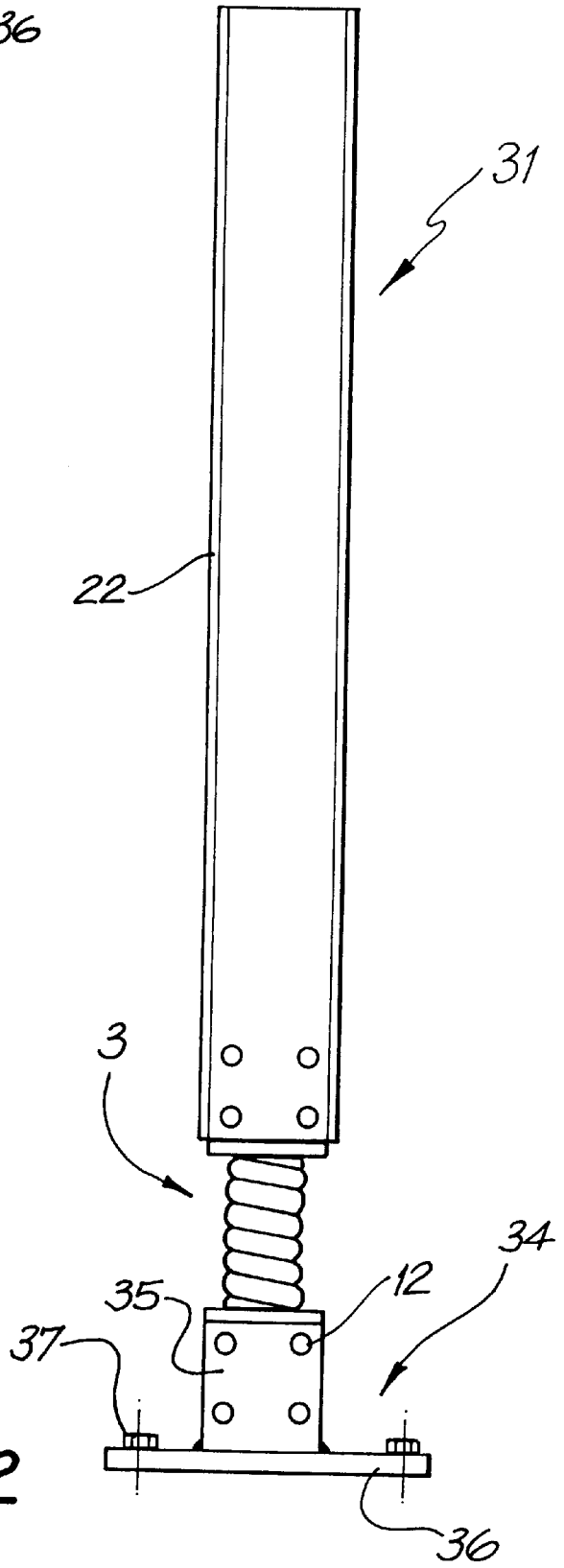
FIG. 12 is a front elevation view of the flexible traffic post of FIG. 11.
Figure 13:
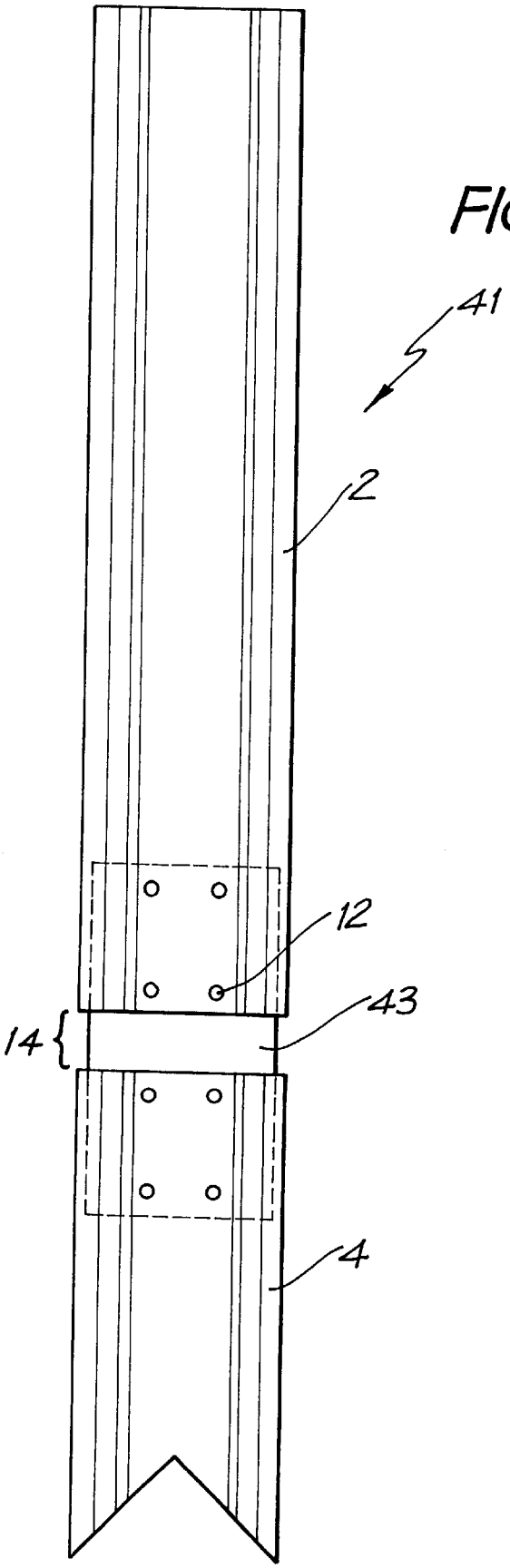
FIG. 13 is a front elevation view of a flexible traffic post according to a fourth embodiment of the current invention.
Figure 14:
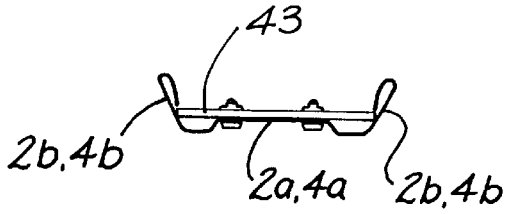
FIG. 14 is a plan view of the flexible traffic post of FIG. 13.

In a traffic post 31 according to a third embodiment, as depicted in FIGS. 11 and 12, the lower post section 4 is replaced with a base 34. An upstanding plate 35 is fastened to the lower attachment plate 8 by means of fasteners 12 through the attachment plate holes 9. A base plate 36 welded to the upstanding plate 35 is fastened to a support base such as a concrete median strip by a plurality of bolts 37. Other similar methods may be used to rigidly secure a lower section of the post 1 below the coupling member 3, In a traffic post 41 according to a fourth embodiment, as depicted in FIGS. 13 and 14, an alternate coupling member 43 is provided. The coupling member 43 comprises a unitary planar sheet of an elastically flexible material such as spring steel or a plastic such as polyurethane. Some elastomers may also be appropriate. The upper and lower post sections 2 and 4 are each in the form of a constant cross section "C" channel, each having a web 2*a*, 4*a* defining a rear face of the post section 2, 4 and opposing flanges 2*b*, 4*b* which project rearwardly from opposing lateral sides of the web 2*a*, 4*a*. The coupling member 43 is disposed interiorly of the channels defined by the respective post sections 2, 4, being fastened to the upper and lower post section webs 2*a*, 4*a* via fasteners 12. A portion of the coupling member 43 left in the gap 14 between the upper and lower post sections 2, 4 is free to flex when the post is impacted.

With the sheet coupling member 43 having a width much greater than its depth it will only flex appreciably in the fore and aft direction, such that the post 41 of this embodiment will only flex substantially when impacted from a direction perpendicular to the plane of the coupling member 43. Accordingly, the post 41 should be generally aligned with the path of oncoming traffic. Whilst the post 41 of this embodiment can only flex in one plane, it is simpler and less expensive to manufacture than the posts of the first three embodiments and hence may be more cost effective in certain situations.

Figure 15:
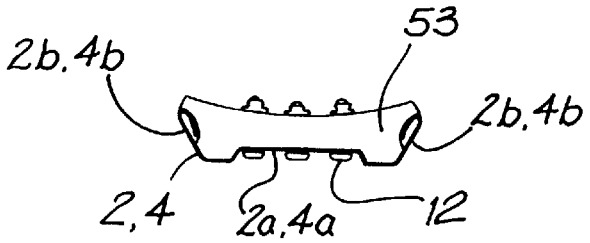
FIG. 15 is a a plan view of a flexible traffic post according to a fifth embodiment of the current invention.
Figure 16:
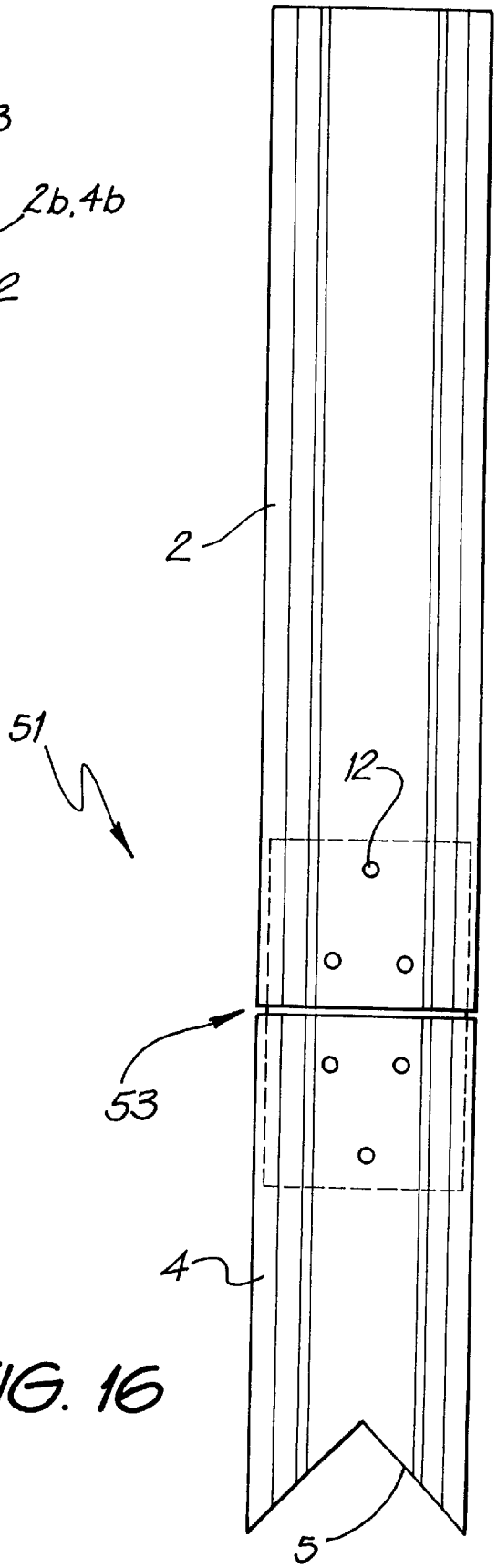
FIG. 16 is a front elevation view of the flexible traffic post of FIG. 15
Figure 17:
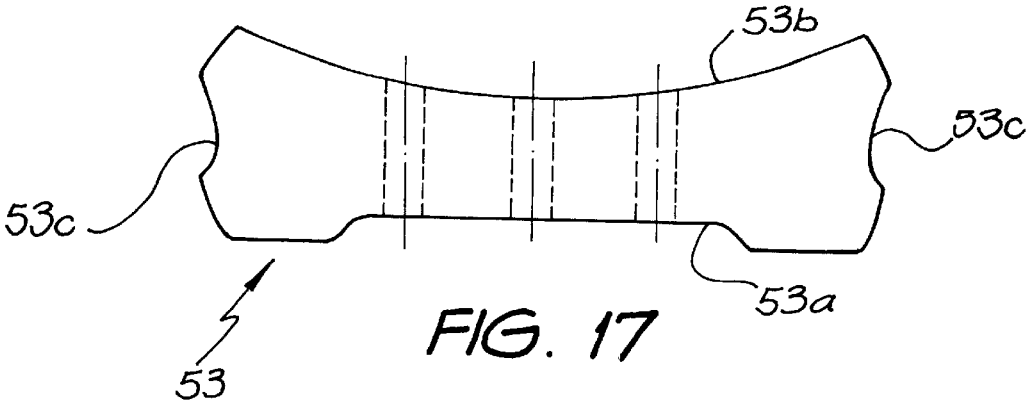
FIG. 17 is a plan view of the coupling member of the flexible traffic post of FIG. 15.
Figure 18:
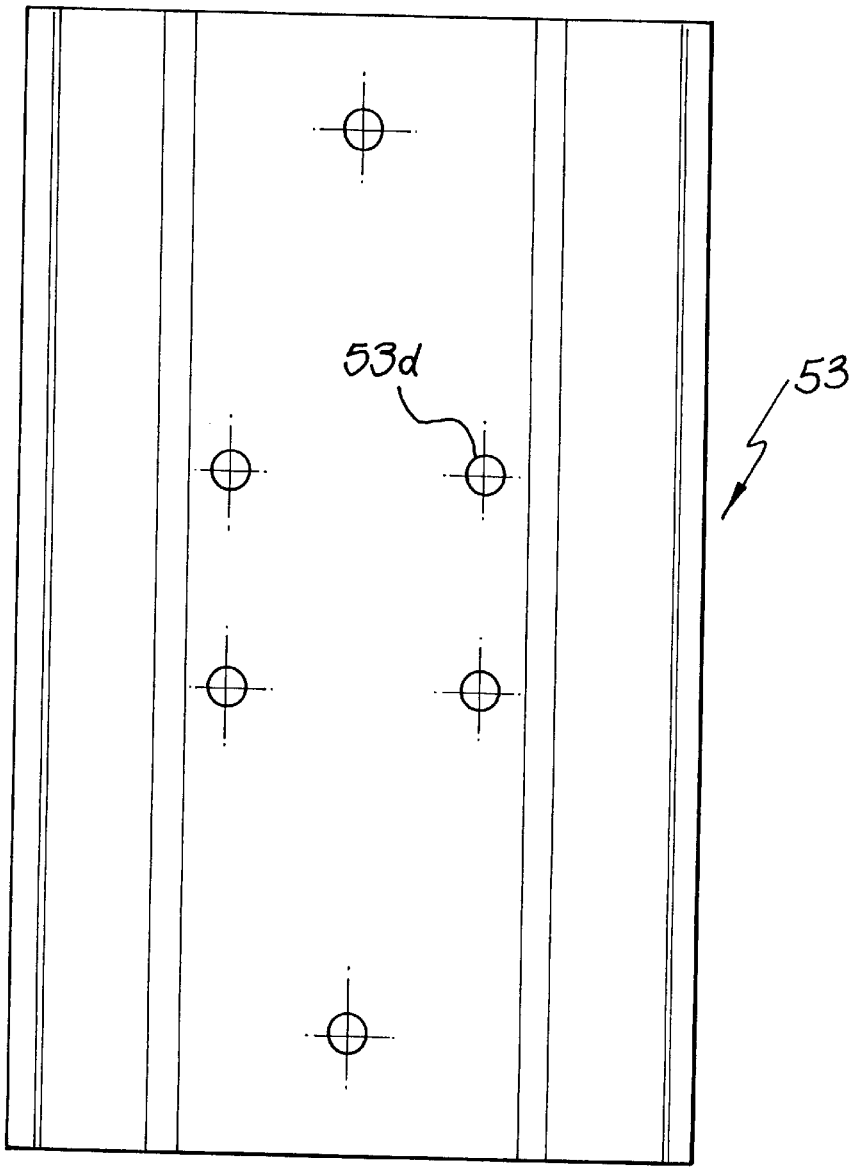
FIG. 18 is a front elevation view of the coupling member of FIG. 17.

A traffic post 51 according to the preferred fifth embodiment is depicted in FIGS. 15 through 20. This traffic post 51 has "C" channel type upper and lower post sections 2, 4 as per the fourth embodiment. The coupling member 53 is disposed interiorly of the channels and is moulded to the shape of the upper and lower post sections 2, 4. In particular, the front face 53*a* of the coupling member 53 is moulded to conform to the shape of the webs 2*a*, 4*a* forming the rear surface of the upper and lower post sections 2, 4. The opposing side surfaces 53*c* of the coupling member 53 abut the opposing flanges 2*b*, 4*b* of the upper and lower post sections 2, 4 and are preferably moulded to conform thereto as depicted in FIG. 15. The coupling member 53 is moulded from polyurethane and is more secure and robust than the planar coupling member 43 of the fourth embodiment. The coupling member 53 has a width greater than its depth so that it is most effective when impacted from a direction perpendicular to the plane of the coupling member 53.

The moulded form of the coupling member 53 enables accurate and simple alignment of the upper and lower post sections 2, 4 during installation. Stability of the coupling member 53 is also enhanced, reducing the possibility of twisting of the post both whilst being driven during installation (see below) and on impact. Conforming the coupling member 53 to the webs 2*a*, 4*a* further supports and strengthens the webs 2*a*, 4*a* in the region at which they are fastened to the coupling member 53.

The rear face 53*b* of the coupling member 53 is curved concavely, with the concavity being oriented such that the face extends with a constant cross section in the longitudinal direction. The concave rear face 53*b* effectively stiffens the side regions of the coupling member 53. This allows the post 51 to return to the vertical position after the coupling member 53 has been flexed through 90°, or further, and provides stability and rigidity to the post 51 when in the upright position enabling it to resist high wind loads. The preferred coupling member 53 depicted has a thickness of approximately 20 mm (0.787 in) at the centre and 35 mm (1.38 in) toward the sides and complies with relative wind loading specification requirements of up to 35 m/s (78 mph). The upper and lower post sections 2, 4 are approximately 110 mm wide.

Figure 19:
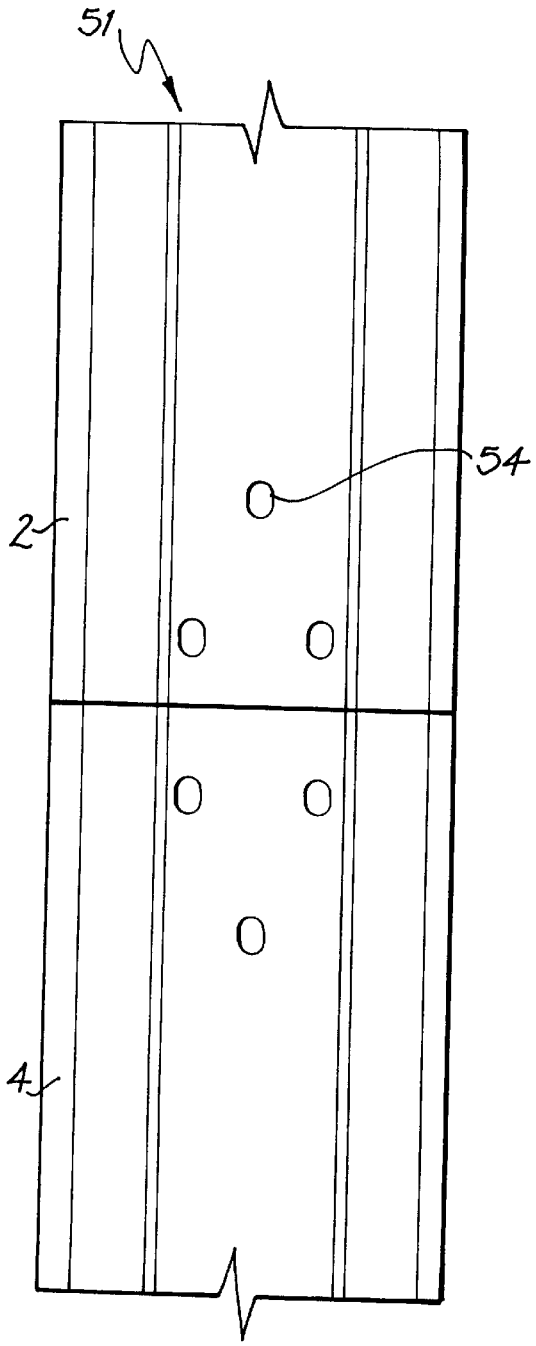
FIG. 19 is a front elevation view of the flexible traffic post of FIG. 15 with the upper and lower post sections in an abutting position.
Figure 20:
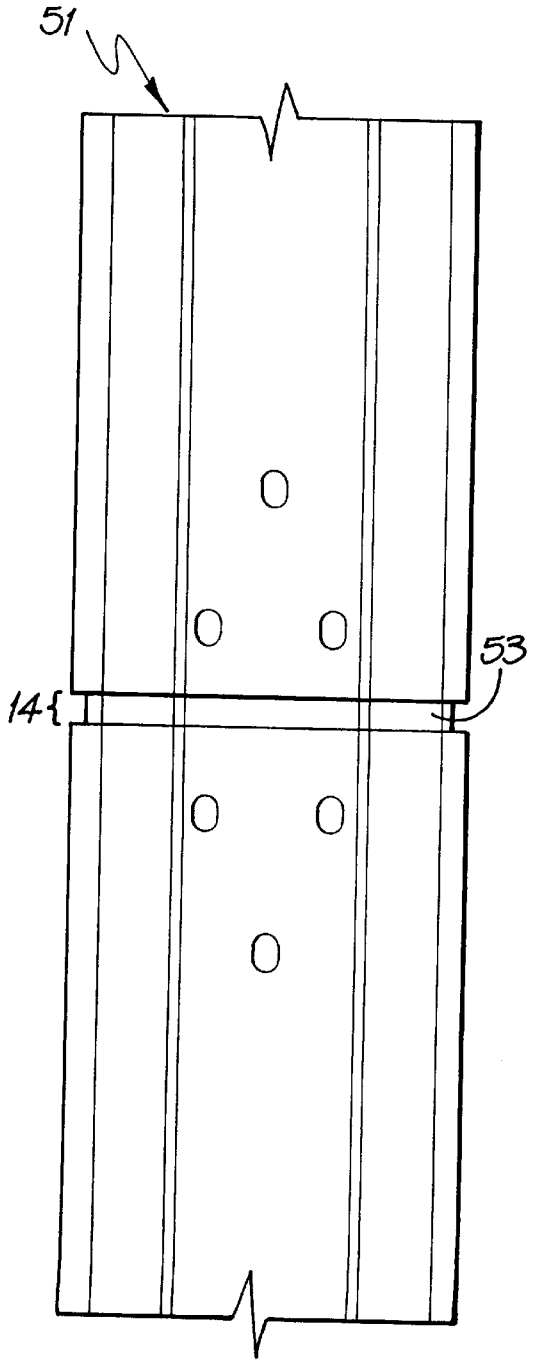
FIG. 20 is a front elevation view of the flexible traffic post of FIG. 15 with the upper and lower post sections in a separated position.

To facilitate driving of the post 51 into a support base, typically being a ground surface, the coupling member 53 is fastened to at least one, and preferably both, of the upper and lower post sections 2, 4 by way of longitudinally extending slots 54. Here the slots 54 are provided in both the upper and lower post sections 2, 4, as depicted in FIGS. 19 and 20. The fasteners 12 have been omitted from these views so as not to obscure the slots 54 from view behind the fastener heads. The slots 54 are located and sized such that the upper and lower post sections can be mutually displaced in the longitudinal direction between an abutting relative position, as depicted in FIG. 19, and a separated position, as depicted in FIG. 20.

In the abutting position, the upper post 2 can be driven downwardly with the driving force being transferred directly to the lower post section 4 at the abutting ends of the post sections. As a result no appreciable load is transferred through the coupling member 53. Potential damage to the coupling member 53, particularly the holes 53d thereof through which the fasteners 12 pass, and buckling of the post 51 during driving can be avoided. When in the abutting position the post Si thus acts generally as a single piece fixed post when it is being driven during installation, enabling currently available post drivers to be employed to drive the post into the ground when fully assembled.

With the upper and lower post sections 2, 4 abutting, the coupling member 53 can not be readily flexed, as the abutting flanges 2*b*, 4*b* will interfere After installation, an impact tending to flex the post will result in relative displacement of the upper and lower post sections 2, 4 to the separated position depicted in FIG. 20. The gap 14 thus produced between the upper and lower post sections 2, 4 will allow the coupling member 53 to flex as required. Here the slots 54 are approximately 10 mm (0.39 in) long providing for a gap 14 of approximately 8 mm (0.31 in) in the separated position. Rather than depending on an impact to separate the upper and lower post sections 2, 4 after installation, the upper and lower post sections 2, 4 could be manually separated into the separated position depicted in FIG. 20 immediately following installation. The fasteners 12 should then be tightened to maintain the upper and lower post sections 2, 4 in the separated position. It will also be appreciated that the fasteners 12 should not be over tightened so as to inhibit separation of the post sections 2, 4 if they are left in the abutting position following installation.

The post 41 of the fourth embodiment may also be arranged with slots to facilitate driving of the post during installation.

Installation of the post 51 is further enhanced by the triangular shaped cut-out 5 provided at the lower end of the web 4*a* of the lower post 4. This cut-out 5 provides the lower end of the lower post section 4 with a fork-type configuration which can penetrate the ground more easily than a flat end. Further, the cut-out 5 separates the opposing flanges 4*b* and enables them to flare out upon being driven into the ground. This flaring out of the flanges 4*b* helps anchor the lower post section 4 beneath the support base surface.

We claim:

1. A traffic post comprising:

a longitudinally extending upper post section, a longitudinally extending lower post section adapted to be driven into a support base, and a longitudinally extending elastically flexible unitary coupling member fastened to said upper and lower post sections, said coupling member being fastened to each of said upper and lower post sections with a front face thereof abutting a rear face of each of said upper and lower post sections, said coupling member having a width greater than a depth thereof so as to enable deflection in a fore and aft direction perpendicular to said width, wherein said coupling member has a longitudinally extending arcuately concave rear face; and wherein said coupling member is fastened to at least one of said upper and lower post sections via fasteners passing through longitudinally extending slots, said slots being located and sized such that said upper and lower post sections are mutually longitudinally displaceable between an abutting relative position for driving of said post into said support base by a driving force applied to said upper post section and a longitudinally separated relative position for flexing of said coupling member.

2. The traffic post of claim 1 wherein said coupling member is moulded of a plastics or elastomeric material.

3. The traffic post of claim 1 wherein said coupling member is moulded of polyurethane.

4. The traffic post of claim 1 wherein said upper and lower post sections are each in the form of a constant cross section channel, said upper and lower post rear faces each being disposed interiorly of the respective said channel such that said coupling member is disposed in said channels.

5. The traffic post of claim 4 wherein said upper and lower post sections are formed as substantially identical constant cross section "C" channels each having a web defining the post section rear face and opposing flanges projecting rearwardly from opposing lateral sides of said web.

6. The traffic post of claim 5 wherein opposing side surfaces of said coupling member abut said opposing flanges.

7. The traffic post of claim 5 wherein a lower end of said lower post section is provided with a triangular shaped cut out through said web so as to provide said lower post lower end with a fork-type configuration.

8. The traffic post of claim 1 wherein said front face of said coupling member is moulded to conform to each of said upper and lower post section rear faces.

9. The traffic post of claim 1 wherein said slots are provided in both of said upper and lower post sections.

10. The traffic post of claim 1 wherein said coupling member comprises a substantially planar flexible sheet member.

11. A traffic post comprising:

a longitudinally extending upper post section, a longitudinally extending lower post section adapted to be driven into a support base, and a longitudinally extending elastically flexible unitary coupling member fastened to said upper and lower post sections, said coupling member being fastened to each of said upper and lower post sections with a front face thereof abutting a rear face of each of said upper and lower post sections, said coupling member having a width greater than a depth thereof so as to enable deflection in a fore and aft direction perpendicular to said width, wherein said coupling member is fastened to at least one of said upper and lower post sections via fasteners passing through longitudinally extending slots, said slots being located and sized such that said upper and lower post sections are mutually longitudinally displaceable between an abutting relative position for driving of said post into said support base by a driving force applied to said upper post section and a longitudinally separated relative position for flexing of said coupling member.

12. The traffic post of claim 11 wherein said slots are provided in both of said upper and lower post sections.

13. The traffic post of claim 11 wherein said coupling member is moulded of a plastics or elastomeric material.

14. The traffic post of claim 11 wherein said coupling member is moulded of polyurethane.

15. The traffic post of claim 11 wherein said upper and lower post sections are each in the form of a constant cross section channel, said upper and lower post rear faces each being disposed interiorly of the respective said channel such that said coupling member is disposed in said channels.

16. The traffic post of claim 15 wherein said upper and lower post sections are formed as substantially identical constant cross section "C" channels each having a web defining the post rear face and opposing flanges projecting rearwardly from opposing lateral sides of said web.

* * * * *